US006502979B1

(12) United States Patent
Kozyuk

(10) Patent No.: US 6,502,979 B1
(45) Date of Patent: Jan. 7, 2003

(54) DEVICE AND METHOD FOR CREATING HYDRODYNAMIC CAVITATION IN FLUIDS

(75) Inventor: Oleg V. Kozyuk, Westlake, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 19 days.

(21) Appl. No.: 09/717,170

(22) Filed: Nov. 20, 2000

(51) Int. Cl.[7] ..... B01F 5/08
(52) U.S. Cl. ..... 366/176.2
(58) Field of Search ..... 366/167.1, 174.1, 366/175.2, 176.1, 176.2, 182.1, 336, 338; 138/37, 40, 42, 43, 46

(56) References Cited

U.S. PATENT DOCUMENTS 1,237,222 A * 8/1917 Schroder
1,925,787 A * 9/1933 Brooks
2,504,678 A * 4/1950 Gardner
2,817,500 A * 12/1957 Robinson
2,868,516 A * 1/1959 Moseley
2,995,346 A * 8/1961 Samples
3,473,787 A * 10/1969 Bartlett
5,366,288 A * 11/1994 Dahllof et al.
5,492,654 A * 2/1996 Kozjuk et al.
5,782,557 A * 7/1998 Young
5,810,052 A * 9/1998 Kozyuk
5,931,771 A * 8/1999 Kozyuk
5,937,906 A * 8/1999 Kozyuk
5,969,207 A * 10/1999 Kozyuk
5,971,601 A * 10/1999 Kozyuk
6,012,492 A * 1/2000 Kozyuk
6,035,897 A * 3/2000 Kozyuk

FOREIGN PATENT DOCUMENTS

WO 96/09112 * 3/1996
WO 98/11983 * 3/1998

* cited by examiner

*Primary Examiner*—Charles E. Cooley
(74) *Attorney, Agent, or Firm*—Beneach, Friedlander, Coplan & Aronoff, LLP

(57) ABSTRACT

This invention provides a device and method for creating hydrodynamic cavitation in fluids which includes a flow-through chamber intermediate an inlet opening and an outlet opening; the flow-through chamber having an upstream opening portion communicating with the inlet opening and a downstream opening portion communicating with the outlet opening; the cross-sectional area of the downstream opening portion being greater than the cross-sectional area of the upstream opening portion; and a cavitation generator located within the flow-through chamber for generating a hydrodynamic cavitation field downstream from the generator. This invention also provides for a device for creating hydrodynamic cavitation in fluids wherein the walls of the flow-through chamber are removable mounted within the device and are interchangeable and replaceable with replacement walls having various shapes and configurations, thereby enabling the flow-through chamber to assume various shapes and configurations to affect cavitation. This invention also provides for a device for a device for creating hydrodynamic cavitation in fluids wherein the baffle elements are removably mounted within the device and are interchangeable and replaceable with replacement baffles having various shapes and configurations thereby enabling variable effects on cavitation.

16 Claims, 4 Drawing Sheets

DEVICE AND METHOD FOR CREATING HYDRODYNAMIC CAVITATION IN FLUIDS

FIELD OF INVENTION

The present invention relates to a device and method for creating hydrodynamic cavitation in fluids, and particularly, to a device and method for creating and controlling hydrodynamic cavitation in fluids wherein the position of structural components which create cavitation and the structural components themselves are easily variable.

BACKGROUND OF THE INVENTION

One of the most promising courses for further technological development in chemical, pharmaceutical, cosmetic, refining, food products, and many other areas relates to the production of emulsions and dispersions having the smallest possible particle sizes with the maximum size uniformity. Moreover, during the creation of new products and formulations, the challenge often involves the production of two, three, or more complex components in disperse systems containing particle sizes at the submicron level. Given the ever-increasing requirements placed on the quality of dispersing, traditional methods of dispersion that have been used for decades in technological processes have reached their limits. Attempts to overcome these limits using these traditional technologies are often not effective, and at times not possible.

Hydrodynamic cavitation is widely known as a method used to obtain free disperse systems, particularly lyosols, diluted suspensions, and emulsions. Such free disperse systems are fluidic systems wherein dispersed phase particles have no contacts, participate in random beat motion, and freely move by gravity. Such dispersion and emulsification effects are accomplished within the fluid flow due to cavitation effects produced by a change in geometry of the fluid flow.

Hydrodynamic cavitation is the formation of cavities and cavitation bubbles filled with a vapor-gas mixture inside the fluid flow or at the boundary of the baffle body resulting from a local pressure drop in the fluid. If during the process of movement of the fluid the pressure at some point decreases to a magnitude under which the fluid reaches a boiling point for this pressure, then a great number of vapor-filled cavities and bubbles are formed. Insofar as the vapor-filled bubbles and cavities move together with the fluid flow, these bubbles and cavities may move into an elevated pressure zone. Where these bubbles and cavities enter a zone having increased pressure, vapor condensation takes place withing the cavities and bubbles, almost instantaneously, causing the cavities and bubbles to collapse, creating very large pressure impulses. The magnitude of the pressure impulses within the collapsing cavities and bubbles may reach 150,000 psi. The result of these high-pressure implosions is the formation of shock waves that emanate from the point of each collapsed bubble. Such high-impact loads result in the breakup of any medium found near the collapsing bubbles.

A dispersion process takes place when, during cavitation, the collapse of a cavitation bubble near the boundary of the phase separation of a solid particle suspended in a liquid results in the breakup of the suspension particle. An emulsification and homogenization process takes place when, during cavitation, the collapse of a cavitation bubble near the boundary of the phase separation of a liquid suspended or mixed with another liquid results in the breakup of drops of the disperse phase. Thus, the use of kinetic energy from collapsing cavitation bubbles and cavities, produced by hydrodynamic means, can be used for various mixing, emulsyfying, homogenizing, and dispersing processes.

Devices are known in the art which utilize the passage of a hydrodynamic flow through a cylindrical flow-through chamber internally accommodating a baffle body installed across and confronting the direction of hydrodynamic flow to produce varied cavitation effects. The baffle element provides a local contraction of the flow as the fluid flow confronts the baffle element thus increasing the fluid flow pressure. As the fluid flow passes the baffle element, the fluid flow enters a zone of decreased pressure downstream of the baffle element thereby creating a hydrodynamic cavitation field.

Once such prior art device is described in U.S. Pat. No. 5,492,654 issued on Feb. 20, 1996 to the Applicant herein and other named inventors and is hereby incorporated by reference herein. The cavitation device of the '654 Patent identifies the art as utilizing a cylindrical flow-through chamber internally accommodating a plurality of baffles elements, wherein the upstream baffle elements have a larger diameter than the downstream baffle elements. Such a device is utilized in an attempt to create and control hydrodynamic cavitation in fluids wherein the position of the baffle elements is variable. However, there is an ever-increasing need to create and control hydrodynamic cavitation to a greater degree.

SUMMARY OF INVENTION

This invention relates to a device and method for creating and controlling the qualitative and quantitative effects of hydrodynamic cavitation. This method and device can find application in areas such as oil processing, petroleum chemistry, and organic and inorganic synthesis chemistry among other areas. Particularly, this device is useful where the effects of cavitation would be beneficial.

This invention provides a device and method for creating hydrodynamic cavitation in fluids comprising a flow-through chamber intermediate an inlet opening and an outlet opening; a flow-through chamber having an upstream opening portion communicating with the inlet opening and a downstream opening portion communicating with the outlet opening; the cross-sectional area of the downstream opening portion of the flow-through chamber being greater than the cross-sectional area of the upstream opening portion of the flow-through chamber; and a cavitation generator located within the flow-through chamber for generating a hydrodynamic cavitation field downstream from the generator.

In the preferred embodiment, the flow-through chamber assumes the shape of a truncated cone wherein the smaller diameter cross-section of the cone (the truncated end) is locate upstream in the device.

This invention also provides at least one baffle element movable within the flow-through chamber thereby effecting the fluid flow pressure at the baffle element to produce controlled cavitation.

This invention also provides a device for creating hydrodynamic cavitation in fluids wherein the walls of the flow-through chamber are removably mounted within the device and are interchangeable with replacement walls having various shapes and configurations thereby enabling the flow-through chamber to assume various shapes and configurations to affect cavitation.

This invention further provides a device for creating hydrodynamic cavitation in fluids wherein the baffle elements of the flow-through chamber are removably mounted within the flow-through chamber and are interchangeable with replacement baffle elements having various shapes and configurations thereby affecting cavitation. In the preferred embodiment, the device utilizes conically-shaped baffle elements. However, given that the baffle elements are removable, the device can utilize baffle elements having variously shaped surfaces and configurations to affect cavitation.

Still other benefits and advantages of the invention will become apparent to those skilled in the art upon reading and understanding this disclosure.

DETAILED DESCRIPTION OF INVENTION

Figure 1:
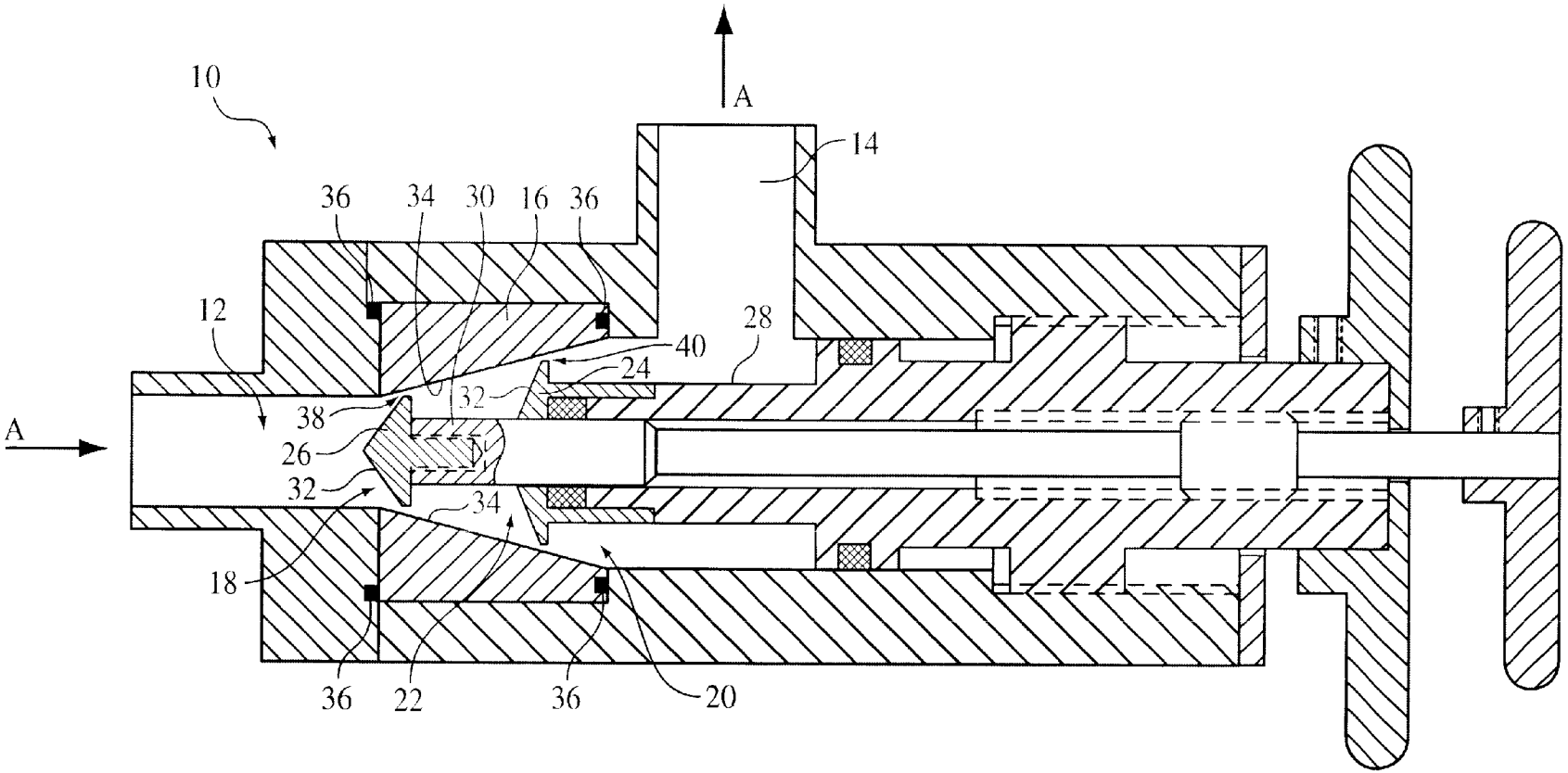
FIG. 1 is a cross-sectional view taken of a longitudinal section of a device for creating hydrodynamic cavitation in fluids having first and second baffle elements.

In accordance with this invention, and as shown in FIG. 1, a device 10 for creating hydrodynamic cavitation in fluids comprises an inlet opening 12 for accepting fluid and dispersants into the device 10; an outlet opening 14 for exiting the fluid and dispersants from the device 10; a flow-through chamber 16 intermediate the inlet opening 12 and the outlet opening 14 having an upstream opening portion 18 communicating with the inlet opening 12 and a downstream opening portion 20 communicating with the outlet opening 14, wherein the cross-sectional area of the downstream opening portion 20 of the flow-through chamber 16 is greater than the cross-sectional area of the upstream opening portion 18 of the flow-through chamber 16; and a cavitation generator 22 located within the flow-through chamber 16 for generating a hydrodynamic cavitation field downstream from the generator 22. Fluid flow in this device 10 is shown in the direction a arrow A in FIGS. 1 through 3.

For the sake of simplicity, cavitation generator 22 of the present invention will be described as having a plurality of baffle elements, and in particular two baffle elements as utilized in the preferred embodiment. However, it should be understood by those skilled in the art that the cavitation generator 22 of this invention could utilize a single baffle element and still be within the scope of the present invention.

Figure 2:
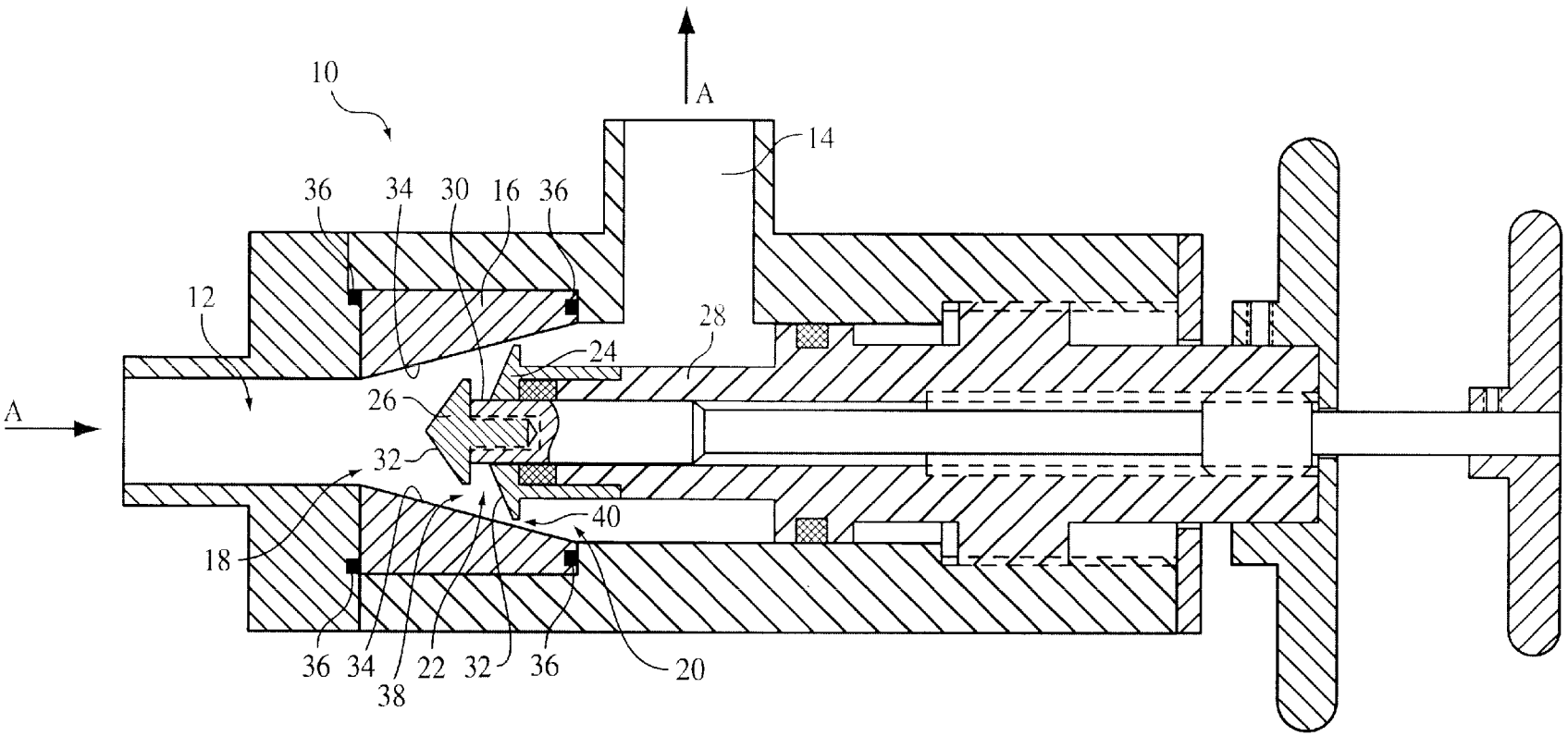
FIG. 2 shows the device of FIG. 1 where the second baffle element is independently movable with respect to the first baffle element.
Figure 3:
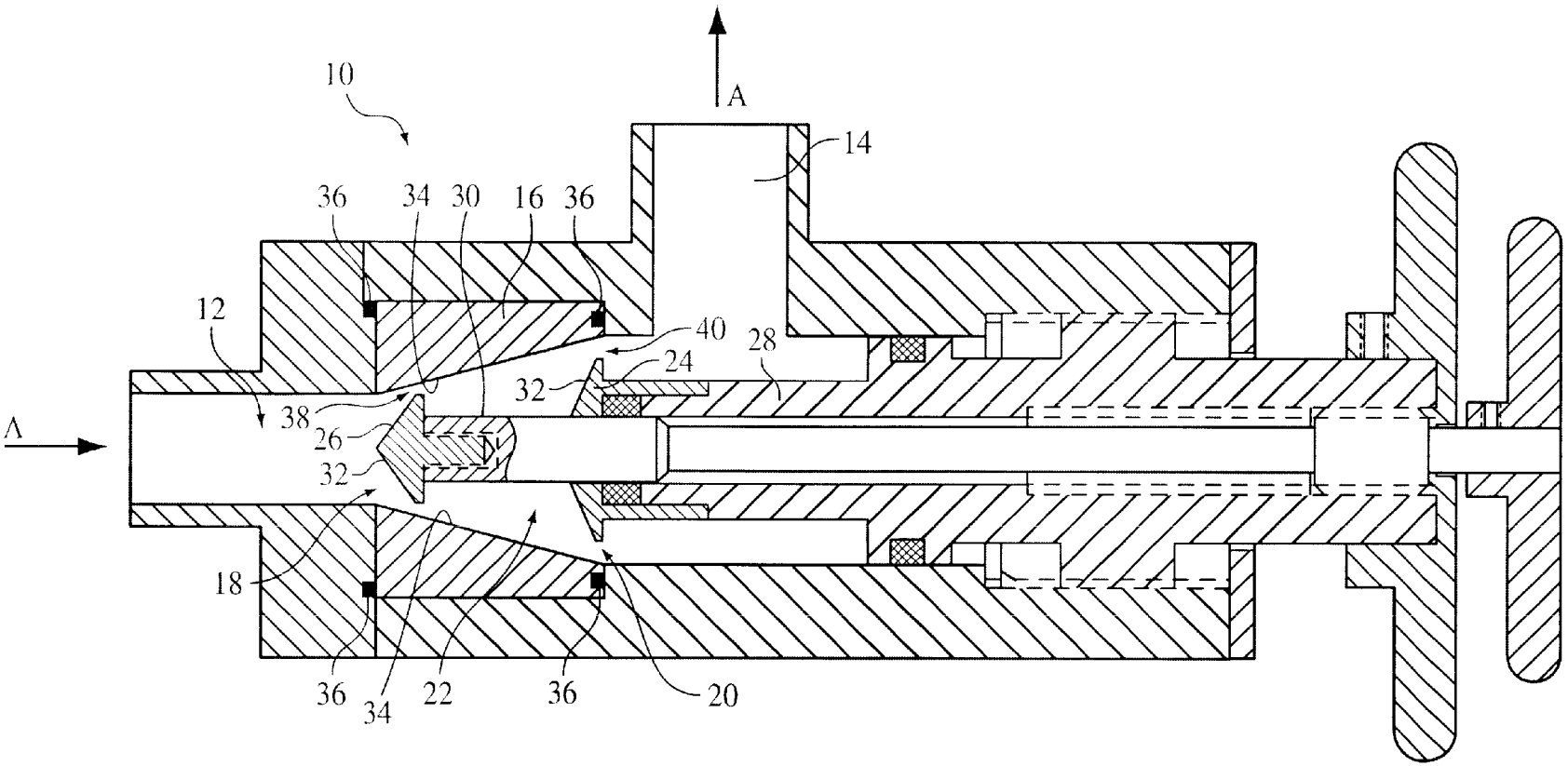
FIG. 3 is shows the device of FIG. 1 where the first baffle element is independently movable with respect to the first second baffle element.

As shown in FIGS. 1 through 3, the first baffle element 24 (or the downstream baffle element) is mounted to the device 10 and located within the flow-though chamber 16 for axial displacement in relation to the flow-though chamber 16. The second baffle element 26 (or upstream baffle element) is interconnected with the first baffle element and extends coaxially upstream from the first baffle element 24. Each interconnected baffle element 24,26 is arranged in succession within the flow-though chamber 16 for generating a hydrodynamic cavitation field downstream from each baffle element 24,26. And because each baffle element 24,26 is independently movable with respect to the other within the flow-though chamber 16 (as shown in FIGS. 2 and 3) between an upstream position and a downstream position, the creation of cavitation fields produced can be controlled and manipulated based on the desired result.

The first baffle element 24 can be movably mounted to the device 10 in any acceptable fashion, however, the preferred embodiment utilizes a rod 28 connected to the downstream portion of the first baffle element 24 wherein the rod 28 is slidably mounted to the device 10 and capable of being locked in a position by a locking means. Likewise, a rod 30 is connected to the downstream portion of the second baffle element 26 wherein the rod 30 is slidably mounted coaxially through the first baffle element 24 and rod 28 and is capable of being locked in a position with respect to the first baffle element 24 and rod 28 by a locking means. Such locking means could comprise a threaded nut or a seal ring or any other means for locking rod 30 with respect to rod 28. Therefore, both the first and second baffle elements 24,26 are independently and slidably movable coaxially within the flow-through chamber 16 to effect the creation and control of cavitation fields.

To further promote the creation and control of cavitation fields, the baffle elements 24,26 are constructed to be removable and replaceable by baffle elements having a variety of shapes and configurations to generate varied hydrodynamic cavitation fields. The shape and configuration of the baffle elements can significantly effect the character of the cavitation flow and, correspondingly, the quality of dispersing. Although there are an infinite variety of shapes and configurations that can be utilized within the scope of this invention, U.S. Pat. No. 5,969,207, issued Oct. 19, 1999, discloses several acceptable baffle element shapes and configurations, and U.S. Pat. No. 5,969,207 is hereby incorporated by reference herein. In the preferred embodiment, baffle elements 24,26 are configured and shaped to include a conically-shaped surface 32 where the tapered portion of the conically-shaped surface 32 confronts the fluid flow. It is also known in the art to restrict the outlet flow to control the hydrostatic pressure of the fluid flow to effect cavitation, such as described in U.S. Pat. No. 5,937,906 issued to Applicant on Aug. 17, 1999, the entire disclosure of which is hereby incorporated by reference herein. Any acceptable restriction means can be used to restrict the outlet flow, such as those known in the art. However, an adjustable valve restriction positioned at the outlet or some distance from the flow through chamber is preferred to obtain the initial desired hydrostatic pressure within said flow-through chamber.

This invention takes advantage of such an adjustable outlet restriction (not shown in FIGS) in order to effect and control the properties of cavitation within the flow-through chamber. Specifically, the adjustable outlet restriction in this invention directly effects the pressure downstream from the first baffle element 24, thereby effecting cavitation in the cavitation zone downstream from the first baffle element 24 (the downstream cavitation zone). The adjustable outlet restriction could likewise effect the pressure downstream from the second baffle element 26, thereby effecting cavitation in the cavitation zone downstream from the second baffle element 26 (the upstream cavitation zone). However, in addition to manipulating or controlling the fluid-flow pressure using an adjustable outlet restriction, one could also, using this invention, manipulate the pressures in both the upstream and downstream cavitation zones by manipulating the positions of the first and second baffle elements 24,26 within the flow-through chamber. Due to the interaction between the baffle elements and the flow-through chamber walls, one could independently manipulate the annular orifice size between the first and second baffle elements 24,26 and the flow-through chamber wall 34 to effect the pressure within one or all cavitation zones. In the preferred embodiment, the hydrostatic pressure upstream from the first baffle element 24 increases as the first baffle element is moved upstream within the flow-through chamber and decreases as the first baffle element 24 is moved downstream within the flow-through chamber. Likewise, the hydrostatic pressure upstream from the second baffle element 26 increase as the second baffle 26 element is moved upstream within the flow-through chamber and decreases as the second baffle element 26 is moved downstream within the flow-through chamber 16.

It is understood that the baffle elements 24,26 can be removably mounted to the rods 28,30 in any acceptable fashion. However, the preferred embodiment utilizes a baffle element that threadedly engages the rod. Therefore, in order to change the shape and configuration of either baffle element 24,26, the rod 28,30 must be removed from the device 10 and the original baffle element unscrewed from the rod and replaced by a different baffle element which is threadedly engaged to the rod and replaced within the device 10.

This invention further utilizes a first baffle element 24 having a greater diameter than the second baffle element 26. The prior art utilizes baffle elements wherein the upstream baffle element has a larger surface area or diameter than the downstream baffle element. Utilizing the prior art baffle configuration, the fluid flow pressure achieved downstream within the flow-through chamber 16 is diminished because the diameter of the downstream baffle element is smaller than the upstream baffle element and the flow-through chamber diameter remains constant. This invention utilizes a unique approach wherein the upstream baffle element 26 has a smaller surface area or diameter than the downstream baffle element 24 to more efficiently control and effect the production of cavitation.

Flow-through chambers utilized in prior art cavitation devices generally consist of mounted, cylindrical chambers internally accommodating at least one baffle element. However, because the flow-through chambers in the prior art have consistent cross-sectional diameters along the fluid flow (i.e. are cylinder-shaped), movement of the baffle element within the flow-through chamber does not effect the hydrodynamic pressure within the flow-through chamber. The only way to effect hydrodynamic pressure in prior art devices is to either increase the fluid pressure at the inlet or provide a baffle element having a larger diameter in order to provide a smaller area between the baffle and the cylindrical flow-through chamber.

Cavitation efficiency and control is achieved using this invention by utilizing a flow-through chamber 16 wherein the cross-sectional area of the downstream opening portion 20 of the flow-through chamber 16 is greater than the cross-sectional area of the upstream opening portion 18 of the flow-through chamber 16. Through this configuration, the annular orifice size between the first baffle element 24 and the flow-through chamber wall 34 and the annular orifice size between the second baffle element 26 and the flow-through chamber wall 34 can be simultaneously and independently manipulated to control the production and effect of cavitation in the device. In the preferred embodiment of this invention, the flow-through chamber 16 utilizes the shape of a truncated cone as shown in FIGS. 1 through 3 and FIG. 4A. However, other shapes can be utilized such as shown in FIGS. 4*b* and 4*c*.

Figure 4C:
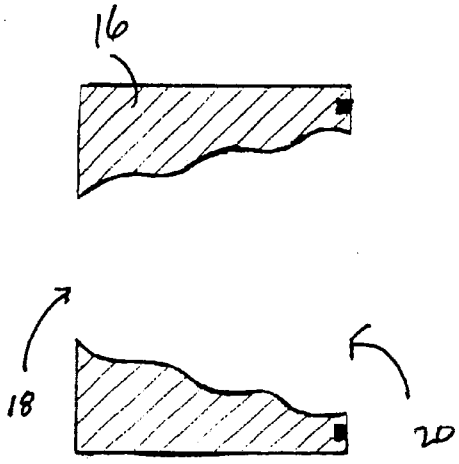
FIGS. 4*a* through 4*c* are cross-sectional views of several removably mounted flow-through chambers having a truncated conical configuration, a stair-stepped configuration, and a variable diameter configuration respectively.
Figure 4B:
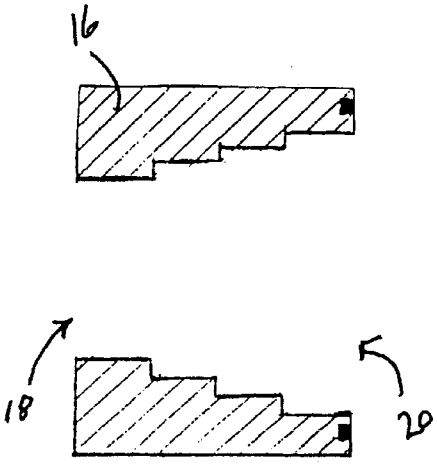
Figure 4A:
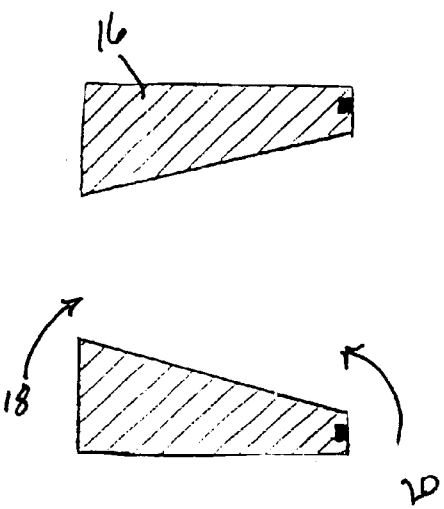

Furthermore, in order to utilize the multiple shapes and configurations of walls available for the flow-through chamber, the walls 34 defining the flow-through chamber 16 can be removably mounted within the cavitation device 10 and are interchangeable with replacement walls having various shapes and configurations such as stair-stepped and wavy as shown in FIGS. 4*b* and 4*c* respectively. By utilizing walls having different shapes and configurations, the flow-though chamber 16 can assume various shapes and configurations to affect cavitation. In the preferred embodiment, the flow-through chamber 16 is removably mounted within the device 10 so that other flow-through chambers having walls having a different shape and configuration can be installed in the device 10 to further effect the control and creation of cavitation. Although the flow-through chamber 16 can be removably mounted to the device in any acceptable fashion, the preferred embodiment utilizes a flow-through chamber die held in place by gaskets or O-rings 36.

In the operation of this device, the hydrodynamic flow of a mixture of liquid and dispersant components moves along arrow A through the inlet opening 12 and enters the flow-through chamber 16 where the fluid encounters second baffle element 26. Due to the surface area controlled by the second baffle element 26 within the flow-through chamber 16, fluid flow is forced to pass between the first annular orifice 38 created between the outer diameter of the second baffle element 26 and the walls 34. By constricting the fluid flow in this manner, the hydrostatic fluid pressure is increased upstream from the first annular orifice 38. As the high pressure fluid flows through the first annular orifice 38 and past the second baffle element 26, a low pressure cavity is formed downstream from the second baffle element 26 which promotes the formation of cavitation bubbles. The resulting cavitation field, having a vortex structure, makes it possible for processing liquid and solid components throughout the volume of the flow-through chamber 16.

As the hydrodynamic flow moves the cavitation bubbles out of the cavitation field, the cavitation bubbles enter an zone having an increased hydrodynamic pressure due to the effect of the downstream first baffle element 24. As the cavitation bubbles enter the increased pressure zone upstream from the first baffle element 24, a coordinated collapsing of the cavitation bubbles occurs, accompanied by high local pressure and temperature, as well as by other physio-chemical effects which initiate the progress of mixing, emulsification, homogenization, or dispersion.

The fluid flow then repeats the identified process by moving through the second annular orifice 40 created between the outer diameter of the first baffle element 24 and the walls 34. By constricting the fluid flow in this manner, the hydrostatic fluid pressure is increased upstream from the second annular orifice 40. As the high pressure fluid flows through the second annular orifice 40 and past the first baffle element 24, a low pressure cavity is formed downstream from the first baffle element 24 which promotes the formation of cavitation bubbles. The resulting cavitation field, having a vortex structure, makes it possible for processing liquid and solid components throughout the volume of the flow-through chamber 16 to initiate a second progress of mixing, emulsification, homogenization, or dispersion. After the flow of a mixture of liquid components is processed in the cavitation fields, the flow mixture is discharged from the device through the outlet opening 14.

In order to attain more precise mixing or dispersion characteristics, the exiting flow can be routed back to the inlet opening 12 to run through the device 10 again. And because the size of each respective annular orifice 38,40 can be independently manipulated due to the relative position between the shape of the flow-through chamber wall and the independently movable baffle element 24,26, an increase in the efficiency and control of cavitation can be achieved. Flow characteristics can be varied by manipulating the size of the first and second annular orifices 24,26 and their relative positions within the flow-through chamber 16. The surface area of a respective annular orifice 38,40 increases as its associated baffle element 24,26 moves downstream through the flow-through chamber thereby decreasing the fluid flow pressure. The surface area of a respective annular orifice 38,40 increases as its associated baffle element 24,26 moves upstream through the flow-through chamber thereby increasing the fluid flow pressure. The ease of manipulating the structural components of the device 10, especially while the process is running to effect flow characteristics, such as were not capable under prior art devices, greatly effects the creation and control of cavitation. And because the level of energy dissipation in a cavitation mixer-homogenizer is mainly dependent on three vital parameters in the cavitation bubble field: the size of the cavitation bubbles, their concentration volume in the disperse medium, and the pressure in the collapsing zone; given the ability of this invention to independently manipulate a number of different structural parameters either alone or together allows for greater creation and control over cavitation and the required quality of dispersion.

The method for creating hydrodynamic cavitation in fluids, according to the invention, consists of passing a fluid through a flow-through chamber having an upstream portion and a downstream portion. The cross-sectional area of the flow-through chamber increases incrementally in the direction of the fluid flow wherein the cross-sectional area of the downstream portion is larger than the cross-sectional area of the upstream portion. Located within the flow-through chamber is at least one baffle element movable coaxially within the flow-through chamber for generating a hydrodynamic cavitation field downstream from the baffle element. As the fluid passes through the flow-through chamber, the fluid encounters the baffle element and creates cavitation as described above.

The method may further comprise providing a second baffle element extending coaxially upstream from the first baffle element within the flow-through chamber for generating a second hydrodynamic cavitation field downstream from the second baffle element. Utilizing the structure described above, a method is disclosed wherein the invention provides means for independently moving each baffle element within the flow-through chamber to permit the manipulation of each hydrodynamic cavitation field within the flow-through chamber. The preferred embodiment of this method utilizes baffle elements having a conically-shaped surface wherein the tapered portion of each conically-shaped surface confronts the fluid flow and wherein each baffle element is interchangeable with baffle elements having variously shaped surfaces and configurations.

While various embodiments for a device and method for creating hydrodynamic cavitation in fluids have been disclosed, it should be understood that modifications and adaptations thereof will occur to persons skilled in the art. Other features and aspects of this invention will be appreciated by those skilled in the art upon reading and comprehending this disclosure. Such features, aspects, and expected variations and modifications of the reported results and are clearly within the scope of the invention where the invention is limited solely by the scope of the following claims.

Having thus defined the invention, I claim:

1. A method for creating hydrodynamic cavitation in fluids, said method comprising:

passing fluid through a flow-through chamber having an upstream portion and a downstream portion, wherein the cross-sectional area of said flow-through chamber increases incrementally in the direction of fluid flow;

providing a first baffle element within said flow-through chamber wherein said first baffle element is movable coaxially within said flow-through chamber for generating a first hydrodynamic cavitation field downstream from said first baffle element, providing a second baffle element coaxially downstream from said first baffle element within said flow-through chamber wherein said second baffle element is movable coaxially within said flow-through chamber for generating a second hydrodynamic cavitation field downstream from said second baffle element, wherein the largest diameter of said second baffle element is greater than the largest diameter of said first baffle element.

2. The method of claim 1, wherein said first and second baffle elements are independently movable with respect to each other.

3. The method of claim 2, further comprising the step of:

providing means for independently moving each said baffle element within said flow-through chamber to permit the manipulation of each said hydrodynamic cavitation field within said flow-through chamber.

4. The method of claim 1, wherein at least one of said first and second baffle elements is interchangeable with a replaceable baffle element having a different shape.

5. The method of claim 4, wherein at least one of said first and second baffle elements is conically-shaped having a tapered portion that confronts the fluid flow.

6. The method of claim 5, wherein the shape of said replaceable baffle element is a sphere.

7. The method of claim 1, wherein the flow-through chamber comprises removable walls that are interchangeable with replacement walls having various configurations thereby enabling said flow-through chamber to interchangeably assume various configurations.

8. The method of claim 7, wherein said removable walls define a conically-shaped flow-through chamber.

9. The method of claim 7, wherein said removable walls define a stair-stepped shaped flow-through chamber.

10. A method for creating hydrodynamic cavitation in fluids, said method comprising:

passing fluid through a diffuser having an upstream portion and a downstream portion wherein the cross-sectional area of said diffuser increases incrementally in the direction of fluid flow;

providing a first baffle element within said diffuser for generating a first hydrodynamic cavitation field downstream from said first baffle element; and providing a second baffle element extending downstream from said first baffle element within said diffuser for generating a second hydrodynamic cavitation field downstream from said second baffle element, wherein the diameter of a circle circumscribing the largest cross-sectional area of said second baffle element is greater than the diameter of a circle circumscribing the largest cross-sectional area of said first baffle element.

11. The method of claim 10, wherein said first baffle element is movable along the axial center of said diffuser.

12. The method of claim 11, wherein said second baffle element is movable along the axial center of said diffuser.

13. The method of claim 12, wherein said first and second baffle elements are independently movable with respect to each other.

14. A method for creating hydrodynamic cavitation in fluids, said method comprising:

passing fluid through a flow-through chamber having an upstream portion and a downstream portion;

providing a first baffle element within said flow-through chamber for generating a first hydrodynamic cavitation field downstream from said first baffle element; and providing a second baffle element extending downstream from said first baffle element within said flow-through chamber for generating a second hydrodynamic cavitation field downstream from said second baffle element, wherein the area between said flow-through chamber and the perimeter of said first baffle element defines a first annular orifice, wherein the cross-sectional area of said first annular orifice increases as said first baffle element is moved downstream through said flow-through chamber, wherein the area between said flow-through chamber and the perimeter of said second baffle element defines a second annular orifice, wherein the cross-sectional area of said second annular orifice increases as said second baffle element is moved downstream through said flow-through chamber, wherein the largest diameter of said second baffle element is greater than the largest diameter of said first baffle element.

15. The method of claim 14, wherein at least one of said first and second baffle elements is conically-shaped having a tapered portion that confronts the fluid flow.

16. The method of claim 14, wherein said first and second baffle elements are independently movable with respect to each other.

* * * * *